US005656981A

United States Patent [19]

Niimi et al.

[11] Patent Number: 5,656,981

[45] Date of Patent: Aug. 12, 1997

[54] MAGNET SWITCH FOR STARTERS

[75] Inventors: Masami Niimi, Handa; Tsutomu Shiga, Nukata-gun; Nobuyuki Hayashi, Nagoya, all of Japan

[73] Assignee: Nippondenso Co., Ltd., Kariya, Japan

[21] Appl. No.: 653,269

[22] Filed: May 24, 1996

[30] Foreign Application Priority Data

May 26, 1995 [JP] Japan ..... 7-128002

[51] Int. Cl.[6] ..... H01H 67/02

[52] U.S. Cl. ..... 335/126; 335/131

[58] Field of Search ..... 335/126, 131

[56] References Cited

U.S. PATENT DOCUMENTS

| | | | |
|---|---|---|---|
| 4,203,084 | 5/1980 | Yamaguchi et al. | 335/202 |
| 5,214,401 | 5/1993 | Kimura et al. | 335/131 |
| 5,424,700 | 6/1995 | Santarelli | 335/126 |
| 5,548,260 | 8/1996 | Kogure et al. | 335/126 |

FOREIGN PATENT DOCUMENTS

| | | |
|---|---|---|
| 54-88563 | 12/1952 | Japan . |
| 50-009635 | 1/1975 | Japan . |
| 51-032342 | 3/1976 | Japan . |
| 59-30564 | 2/1984 | Japan . |

*Primary Examiner*—Lincoln Donovan

*Attorney, Agent, or Firm*—Cushman, Darby & Cushman IP Group of Pillsbury Madison & Sutro LLP

[57] ABSTRACT

In a starter, when a magnet switch is operated for starter operation, an auxiliary movable contact connected to a main movable contact by a holding member comes into contact with an auxiliary stationary contact to supply an electric current from a battery through resistors, auxiliary stationary contact and auxiliary movable contact to apply a low voltage to a motor for low speed rotation. Subsequently, as a plunger of the magnet switch moves further, the main movable contact comes into electrical contact with a main stationary contact, so that the resistors are short-circuited and the electric current from the battery flows to the motor without flowing through the resistors to drive the motor for high speed rotation.

15 Claims, 7 Drawing Sheets

FIG. 9A1
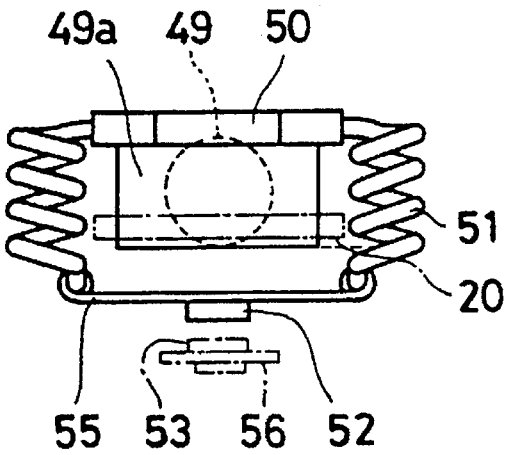
FIG. 9A2
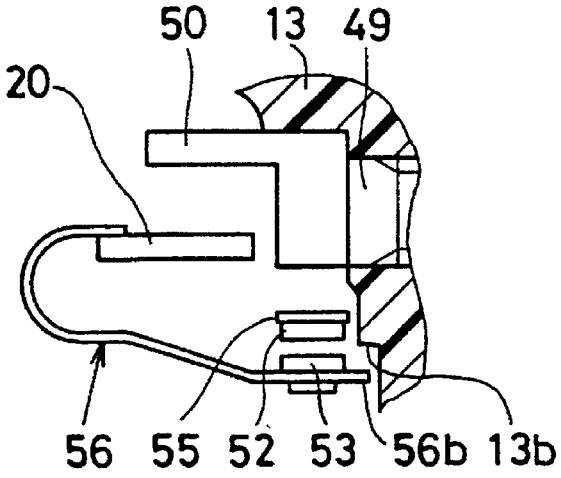
FIG. 9B1
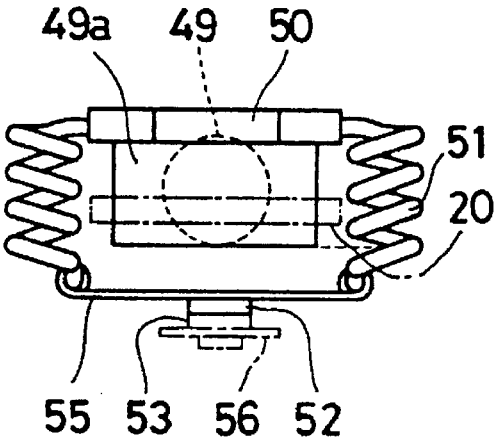
FIG. 9B2
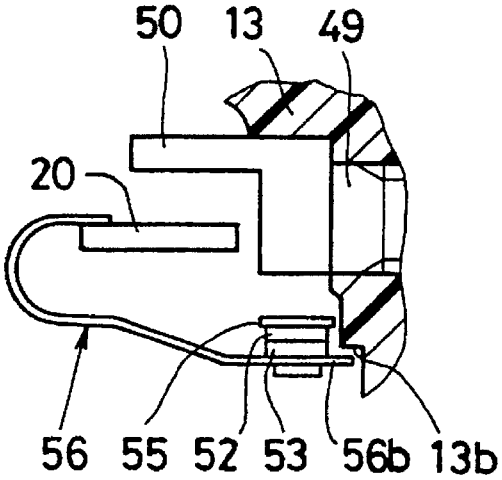

FIG. 10A1
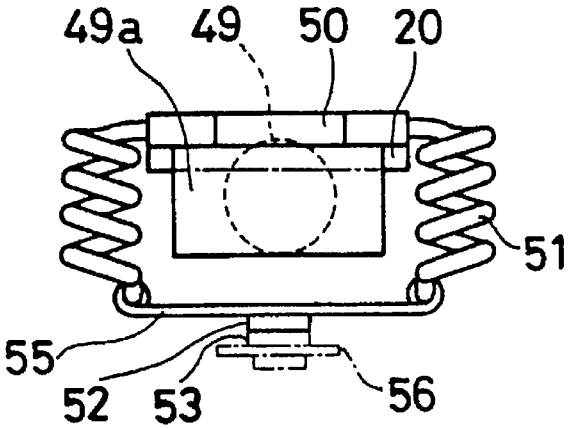
FIG. 10A2
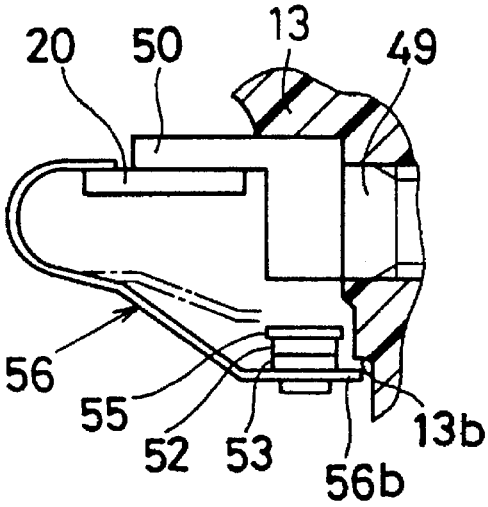
FIG. 10B1
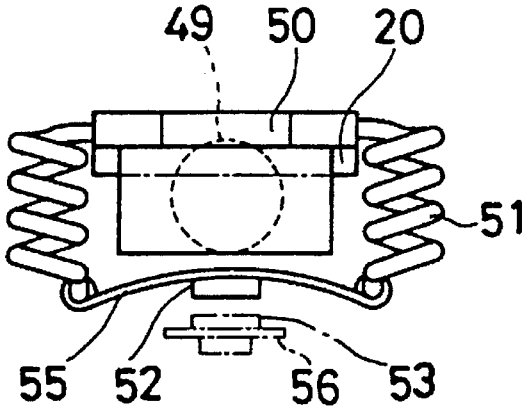
FIG. 10B2
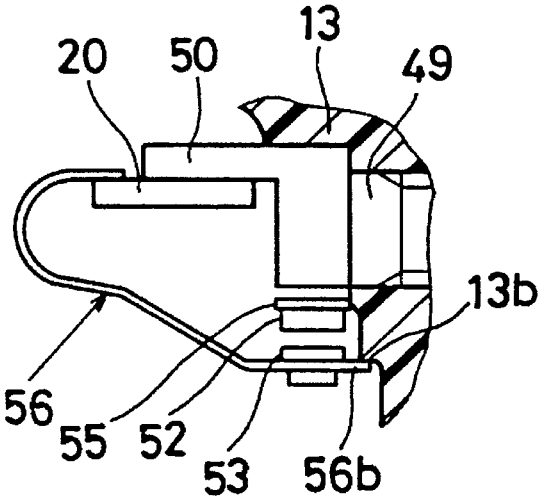

MAGNET SWITCH FOR STARTERS

BACKGROUND OF THE INVENTION

1. Field of the Invention

The present invention relates to a magnet switch for starter for starting an engine.

2. Description of Related Art

There have been proposed starters in which a starter motor is operated in two steps to bring a pinion into an engagement with a ring gear of an engine smoothly. In such starters as disclosed for example in JP-U No. 59-30564, a voltage lower than a rated voltage for the motor is applied through a fixed resistor connected to a motor circuit until the pinion is brought into engagement with the ring gear, and short-circuits the fixed resistor after the pinion and the ring gear have been engaged to apply the rated voltage to the motor.

When the motor is thus actuated in two steps, the motor operates at a low rotating speed until the pinion and the ring gear are engaged and, consequently, impulsive force or shock that acts on the pinion and the ring gear when the pinion and the ring gear are engaged can be reduced to prevent damaging the tooth surfaces of the pinion and the ring gear.

When the impulsive force that acts on the pinion and the ring gear when the same are engaged is reduced, the strength of a speed reduction mechanism of a reduction type starter, which is prevalently used to improve starting performance or to reduce the size, may be reduced.

Reduction in torque for actuating the motor reduces a tangential force for rotating the pinion. Consequently, the pinion can be satisfactorily advanced toward and brought into engagement with the ring gear by a reduced thrust. Therefore, the thrust can be produced by a magnet switch that generates a reduced attraction and the magnet switch may be of a relatively small size.

When the starter is used in a cold district, frost is formed on the surface of a stationary contact built in the magnet switch when the starter held in a high-temperature, high-humidity atmosphere during the operation of the engine is cooled rapidly after the engine has been stopped and the frost may possibly be frozen to ice the surface of the contact.

Since an electric wiring cable of a large diameter connected to a battery is connected to the power terminal of the magnet switch, the cable starts cooling down first after the engine has been stopped, the power terminal of the magnet switch connected to the cable cools down accordingly, and then the stationary contact formed integrally with the power terminal cools down.

If highly humid air prevails in the magnet switch, moisture contained in the air condenses in drops of dew, the drops of dew change into frost and finally ice.

When a compact-sized magnetic switch capable producing a relatively low attraction is used under such condition, impulsive force that is exerted on the stationary contact of the magnet switch by the movable contact when the movable contact is brought into contact with the stationary contact is relatively low. Therefore, if the surface of the stationary contact is iced, the movable contact and the stationary contact can not be satisfactorily connected, which may increase the probability of malfunction.

For preventing malfunction due to the icing of the contact, a starter disclosed in JP-U No. 54-88563 employs a magnet switch having a stationary contact and a movable contact at least one of which has a surface provided with a plurality of grooves to enable layers of ice formed on the surfaces of the contacts to be easily broken upon the collision of the movable contact and the stationary contact so that the movable contact is able to come into satisfactory electrical contact with the stationary contact.

The starter of this type, however, is unable to give full play to its effect when the compact-sized magnet switch is used because such compact magnet switch exerts only a reduced impulsive force on the contacts when the movable contact is brought into contact with the stationary contact.

Other starters disclosed in JP-U Nos. 50-9635 and 51-32342 employ a heating wire disposed so as to surround contacts of a magnet switch to melt ice formed on the surfaces of the contacts by heat generated by the heating wire.

The starters with such heating wire that emits radiant heat to melt the ice takes a relatively much time. Therefore, it is unable to meet the user's requirement that the engine be started as soon as possible, and needs parts for controlling power supply to the heating wire increasing the cost.

SUMMARY OF THE INVENTION

It is therefore an object of the present invention to provide an improved magnet switch for starters.

It is another object of the present invention to provide a magnet switch which operates a starter motor in two steps without being affected by icing contacts.

According to the present invention, in a magnet switch for operating a starter motor, a pair of stationary contacts, main and auxiliary, are provided for controlling the starter motor in two steps, at low speed first and then at high speeds. A heat generating member such as a heat generating type resistor is provided so that it may be used for both speed control and deicing.

Preferably, in association with the main and auxiliary stationary contacts, a pair of movable contacts, main and auxiliary, are provided on a plunger so that the auxiliary and stationary movable contacts are moved by the plunger to contact the auxiliary and stationary contacts respectively in a time sequential manner for the motor speed control.

More preferably, a holding member which is elastic and electrically conductive is provided to connect the auxiliary stationary contact to the main movable contact mechanically and electrically.

More preferably, a contact holding member such as a bimetal is provided between the heat generating member and the auxiliary stationary contact to hold the auxiliary stationary contact.

More preferably, the heat generating member includes a pair of heat generating elements which are connected to the main stationary contact at one ends thereof and to the contact holding member at another ends thereof.

Still more preferably, the heat generating member is made of a thermally sensitive resistor having a positive temperature-resistance characteristics.

BRIEF DESCRIPTION OF THE DRAWINGS

Other objects and features of the present invention will become more apparent from the following detailed description when read in conjunction with the accompanying drawings, in which:

FIGS. 9A1 through 9B2 are front views and side sectional views of a contact device of FIG. 8;

FIGS. 10A1 through 10B2 are front views and side sectional views of a contact device of FIG. 8.

DETAILED DESCRIPTION OF PRESENTLY PREFERRED EMBODIMENTS

Starters according to the present invention will be described hereinafter in detail with reference to presently preferred embodiments.

First Embodiment

Figure 1:
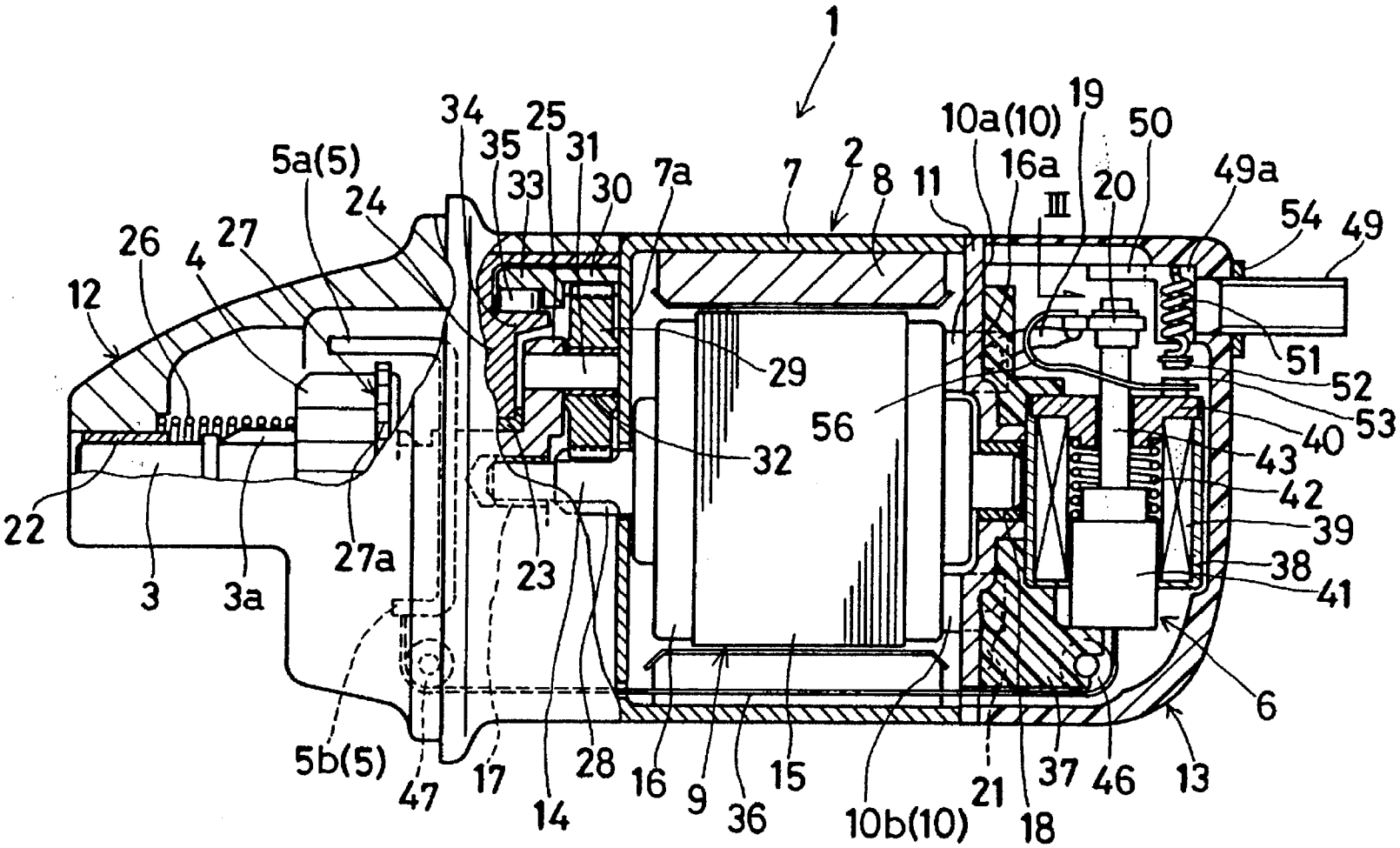
FIG. 1 is a side view of a starter, partly in cross section, according to a first embodiment of the present invention.
Figure 2:
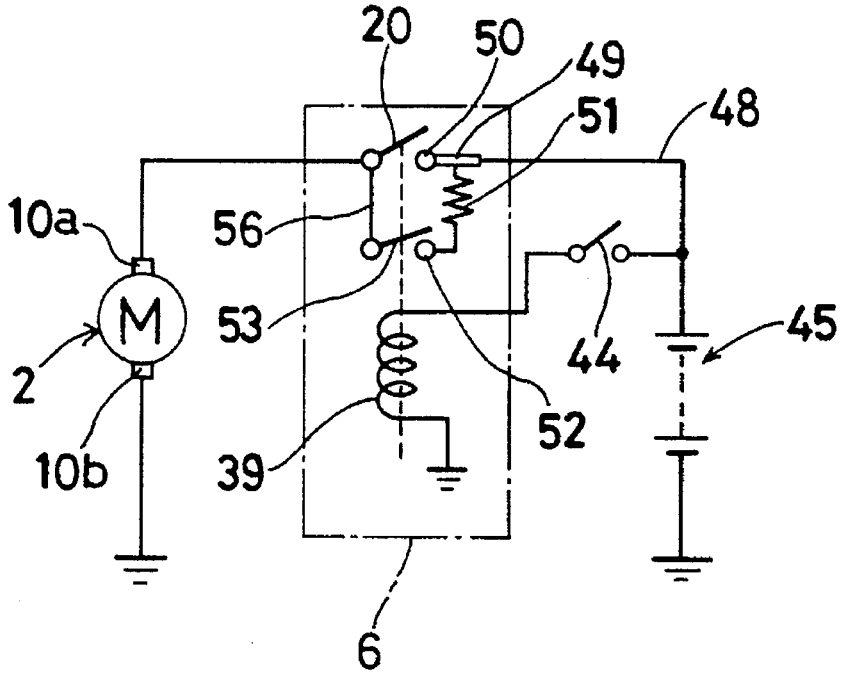
FIG. 2 is an electric circuit diagram of a motor circuit included in a motor of FIG. 1.

FIG. 1 is a sectional view of a starter 1 and FIG. 2 is a circuit diagram of a motor circuit.

The starter 1 in this embodiment generally comprises a motor 2 that generates a rotation torque when powered or supplied with an electric current, an output shaft 3 rotated by the torque of the motor 2, a pinion 4 mounted on the output shaft 3, a torque transmitting mechanism, which will be described later, that transmits the torque of the motor 2 to the output shaft 3, a rotation control member 5 for controlling the rotation of the pinion 4 at the initial stage of starter operation, a magnet switch 6 disposed behind the motor 2 (on the right side of the motor 2 in FIG. 1), and a contact device, which will be described later, for opening and closing the motor circuit of FIG. 2.

Motor 2

The motor 2 comprises a yoke 7, stator magnetic poles 8, armature 9 and a brush assembly 10.

The yoke 7 is formed, for example, by press working (deep drawing) in a cylindrical shape and has only one open end at its rear end (right end in FIG. 1). The yoke 7 is held together with a brush holder 11 disposed behind the yoke 7 between a housing 12 and an end cover 13. The front end of the yoke 7 is bent radially inward to form a partition wall 7*a* separating the motor 2 from the torque transmitting mechanism.

The stator magnetic poles 8 are, for example, a plurality of permanent magnets and are fixed to the inner circumference of the yoke 7 to provide magnetic fields. The stator magnetic poles 8 may be field windings that produce constant-strength magnetic fields when energized in place of the permanent magnets.

The armature 9 comprises a shaft 14, i.e., a rotary shaft, an armature core 15, and armature windings 16 wound on the armature core 15. The shaft 14 has a front end supported for rotation by a bearing 17 and fitted into a recess formed at the rear end of the output shaft 3, and a rear end supported for rotation by a bearing 18 on the holder 11.

The armature windings 16 are bent along the axial side end surfaces of the armature core 15 to form a commutator 16*a* on the rear side end surface of the armature 9.

The brush assembly 10 comprises at least a set of a positive pole brush 10*a* and a negative pole brush 10*b*, which are held on the holder 11 and are pressed axially against the commutator 16*a* with respective springs, not shown. A lead wire 19 having one end electrically connected to the positive pole brush 10*a* and the other end electrically connected to a high-voltage (main) movable contact 20 for full-voltage operation (high motor speed operation) is extended in a properly slack state. A lead wire 21 has one end electrically connected to the negative pole brush 10*b* and the other end electrically connected to the holder 11 made of a metal for electrical rounding.

Output Shaft 3

The output shaft 3 is extended coaxially with the shaft 14 of the armature 9 and has a front end supported for rotation by a bearing 22 on the housing 12 and a rear end supported for rotation in a bearing 23 on a center case 24 disposed in the housing 12. A planet carrier 25 provided in a planetary reduction gear is formed integrally with the output shaft 3 by radially expanding the rear end of the output shaft 3. Helical splines 3*a* are formed on the outer circumference of the output shaft 3 and the pinion 4 is mounted on the splined portion of the output shaft 3.

Pinion 4

Helical splines, not shown, are formed on the inner circumference of the pinion 4 and the helical splines are in engagement with the helical splines 3*a* of the output shaft 3. The pinion 4 is advanced along the helical splines 3*a* to bring the pinion 4 into engagement with a ring gear of an engine flywheel, not shown. The pinion 4 is biased constantly rearward relative to the output shaft 3 with a spring 26 disposed on the front side of the pinion 4. A rotation control plate 27 in a flange shape of a diameter greater than that of the pinion 4 is formed integrally with the pinion 4 at the rear end of the pinion 4. A plurality of axial grooves or teeth 27*a* are formed on the outer circumference of the rotation control plate 27 at equal angular intervals. The number of the axial grooves 27*a* is greater than that of the teeth of the pinion 4.

Torque Transmitting Mechanism

The torque transmitting mechanism comprises a planetary reduction gear (reduction gear of the present invention) and an overrunning clutch. The torque transmitting mechanism is disposed on the front side of the partition wall 7*a* of the yoke 7 and is contained in the center case 24.

The planetary reduction gear converts the rotating speed of the armature 9 into a reduced output rotating speed and provides a torque greater than the output torque of the motor 2. The planetary reduction gear comprises a sun gear 28 formed on the front end of the shaft 14, three planetary gears 29 in engagement with the sun gear 28, an internal gear 30 in engagement with the planetary gears 29, and the planet carrier 25.

The sun gear 28 rotates together with the shaft 14 to transmit the rotation of the shaft 14 to the three planetary gears 29. The three planetary gears 29 are supported for rotation on respective pins 31 fixed to the planet carrier 25 by bearings 32 so as to be in engagement with the sun gear 28 and the internal gear 30. The planetary gears 29 revolve around the sun gear 28 to transmit a torque to the output shaft 3 by rotating the planet carrier 25 at a rotating speed corresponding to the revolving speed thereof.

The internal gear 30 formed in a cylindrical shape is inserted in the center case 24 so as to be rotatable with its outer circumference thereof in sliding contact with the cylindrical inner circumference of the center case 24.

An overrunning clutch is provided to allow the internal gear 30 of the planetary reduction gear to turn only in one direction, i.e., in a direction in which the internal gear 30 is rotated by the engine. The overrunning clutch comprises an outer race 33, an inner race 34, rollers 35 and respective springs, not shown.

The outer race 33 is formed integrally with the internal gear 30 at the front end of the internal gear 30. A plurality of cam recesses or grooves, not shown, having the shape of a wedge are formed in the inner circumference of the outer race 33 at angular intervals.

The inner race 34 is formed integrally with the center case 24. An annular space of a predetermined width is defined by the inner circumference of the outer race 33 and the outer circumference of the inner race 34. The rollers 34 are received in the corresponding cam recesses, respectively. When transmitting the torque of the motor 2 to the output shaft 3, the rollers 35 lock the outer race 33 and the inner race 34 together to control the rotation of the outer race 33. The springs are received in the cam recesses to bias the rollers 35 toward a position to lock the outer race 33 and the inner race 34 together.

Rotation Control Member 5

The rotation control member 5 is a spring member formed by coiling a metal wire bar by about 3/2 turns. The diametrically opposite ends of the rotation control member 5 are bent in the same direction at right angles to form axially extending raised portions **5*a* and 5*b*. The raised portion 5*a* is positioned to be engageable with the groove 27*a* formed on the outer circumference of the rotation control plate 27 at the initial stage of operation of the starter 1 to control or restrict the rotation of the pinion 4. One end of a string-like member 36, such as a wire, is connected to the other raised portion 5*b* to transmit the action of the magnet switch 6 to the raised portion 5*b***.

The rotation control member 5 is held so as not to be axially movable relative to the center case 24 (not movable in horizontal directions in FIG. 1) and to be movable in directions perpendicular to the axis of the starter 1 (movable in vertical directions in FIG. 1). The rotation control member 5 is biased constantly upward by a return spring, not shown. When the magnet switch 6 is turned on and the action of the magnet switch 6 is transmitted through the string-like member 36 to the end portion **5*b*, the rotation control member 5 is moved down against the force of the return spring. When the magnet switch 6 is turned off, the rotation control member 5 is returned upward to its initial position shown in FIG. 1** by the force of the return spring.

Magnet Switch 6

The magnet switch 6 is held fixedly in the end cover 13 on a base 37 pressed in the holder 11 so that the direction of its action is perpendicular to the axis of the shaft 14 of the armature 9.

The magnet switch 6 comprises a switch cover 38, a coil 39, a stationary core 40, a plunger 41, a return spring 42 and a rod 43. The switch cover 38 is formed of a magnetic material, such as iron, in the shape of a cup by press working. An opening for slidably receiving the plunger 41 therethrough is formed in the central portion of the bottom wall (lower wall in FIG. 1) of the switch cover 38.

As shown in FIG. 2, the coil 39 is connected through a starter switch 44 of a vehicle to a battery 45 of the vehicle. When the starter switch 44 is turned on to energize the coil 39, the coil 39 generates a magnetic force.

The stationary core 40 is disposed on the upper end of the coil 39 and is fixed to the open end of the switch cover 38 by staking. The plunger 41 is formed of a magnetic material, such as iron, in a cylindrical shape and is inserted in the central hole of the coil 39 opposite to the stationary core 40. When the coil 39 is energized, the plunger 41 is attracted toward the stationary core 40. The other end of the string-like member 36 is connected to the lower end of the plunger 41. The string-like member 36 is extended through a guide roller 46 supported on the base 37 and a guide roller 47 supported on the center case 24 to the rotation control member 5 to transmit the action or movement of the plunger 41 to the rotation control member 5.

The return spring 42 is inserted in an annular space between the inner circumference of the coil 39 and the plunger 41 and is strained between the plunger 41 and the stationary core 40 so as to normally bias the plunger 41 away from the stationary core 40 (downward in FIG. 1). When the coil 39 is de-energized, the plunger attracted to the stationary core 40 against the force of the return spring 42 is returned to its initial position shown in FIG. 1 by the return spring 42.

The rod 43 made of an insulating material, such as a resin, is fixed to the upper end of the plunger 41 so as to extend through the central hole of the coil 39 and slidably through an opening formed in the central portion of the stationary core 40 and to project upward from the stationary core 40.

Contact Device in Motor Circuit

As shown in FIG. 2, the contact device has a power or battery terminal 49 connected by a battery cable 48 to the battery 45, a main stationary contact 50 for full-voltage or high speed operation, a main movable contact 20 for full-voltage operation movable relative to the main stationary contact 50, resistors 51 (heat generating member) electrically connected to the power terminal 49, an auxiliary fixed contact 52 for low-voltage or low speed operation connected through the resistors 51 to the power terminal 49, and an auxiliary movable contact 53 for low-voltage operation movable relative to the auxiliary stationary contact 52.

As shown in FIG. 1, the power terminal 49 penetrates the end cover 13 with one end thereof projecting outward and rearward from the end cover 13 and is fastened to the end cover 13 with a washer 54.

The main stationary contact 50 is formed integrally with the head **49*a* of the power terminal 49 and disposed within the end cover 13. The main movable contact 20 is attached to the extremity of the rod 43 of the magnet switch 6 so as to be opposite to the main stationary contact 50**.

Figure 3:
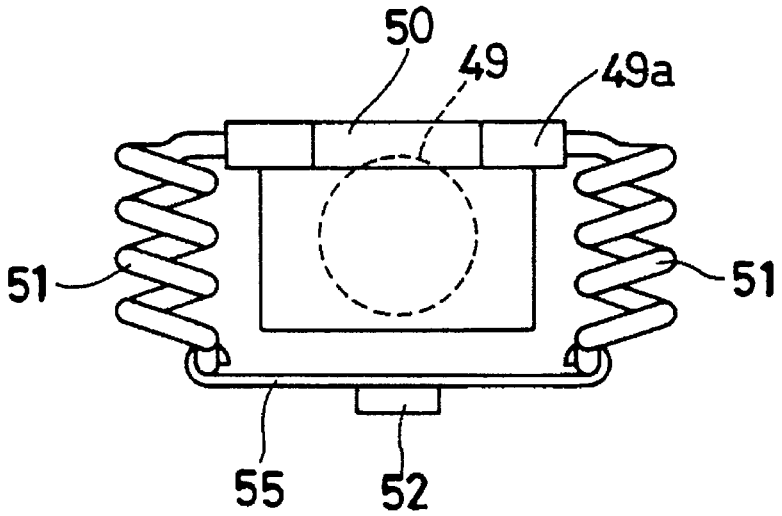
FIG. 3 is a front view of the contact device when viewed along the arrow III in FIG. 1.

The resistors 51 are formed in coil form by winding a metal wire, such as an iron-chromium wire or a nickel-chromium wire. As shown in FIG. 3 (a view taken along the arrow III in FIG. 1), the resistors 51 are disposed on the opposite sides of the head **49*a* of the power terminal 49, respectively, and each of the resistors 51 has one end connected to the side surface of the head 49*a* of the power terminal 49, i.e., to the main stationary contact 50, and the other end connected to a plate-shaped contact holding member 55** of a conductive material.

The auxiliary stationary contact 52 is fixed to the central portion of the lower surface of the contact holding member 55 by welding or the like. The auxiliary movable contact 53 is connected to the main movable contact 20 by a holding arm member 56 and is disposed opposite to the auxiliary stationary contact 52.

As shown in FIG. 1, the holding arm member 56 is a curved, elastic metal strip and has one end mechanically and electrically connected to the main movable contact 20 and the other end mechanically and electrically connected to the auxiliary movable contact 53.

In this contact device, the distance between the auxiliary movable contact 53 and the auxiliary stationary contact 52 is set smaller than that between the main movable contact 20 and the main stationary contact 50. When the magnet switch 6 is actuated by the switch 44 to move the plunger 41 upward, as viewed in FIG. 1, together with the rod 43, the auxiliary movable contact 53 comes into contact with the auxiliary stationary contact 52 before the main movable contact 20 comes into contact with the main stationary contact 50, so that the supply voltage (battery voltage) on the terminal 49 is applied through the resistors 51, holding member 56, main movable contact 20 and lead wire 19 to the motor 2, and then the main movable contact 20 comes into contact with the main stationary contact 50, so that the resistors 51 are short-circuited and the full voltage is applied to the motor 2 through the lead wire 19.

Operation

The operation of this embodiment will be described hereinafter.

When the magnet switch 6 is actuated by turning on the starter switch 44, the plunger 41 moves upward pulling the string-like member 36 toward the magnet switch 6 to move the rotation control member 5 downward along the center case 24. Consequently, the raised portion 5*a* of the rotation control member 5 engages with one of the grooves 27*a* of the rotation control plate 27 to restrict the rotation of the pinion 4.

The plunger 41 is attracted further toward the stationary core 40 and the rod 43 is raised, the auxiliary movable contact 53 comes into contact with the auxiliary stationary contact 52. Then, an electric current flows through the power terminal 49→the resistors 51→the auxiliary stationary contact 52→the auxiliary movable contact 53→the holding arm member 56→the main movable contact 20→the lead wire 19→the positive pole brush 10*a*→the armature 9→the negative pole brush 10*b*→a lead wire 21→the holder 11 and a reduced voltage lower than the battery voltage is applied to the motor 2, so that the motor 2 starts operating at a reduced or low rotating speed. The rotating speed of the motor 2 (the armature 9) is reduced by the planetary reduction gear and a reduced rotating speed is transmitted to the output shaft 3 to rotate the output shaft 3 at the reduced rotating speed. Although the pinion 4 tends to rotate together with the output shaft 3, the torque of the output shaft 3 acts as a thrust to push the pinion 4 axially on the output shaft 3 because the pinion 4 is restrained from rotation by the raised portion 5*a*. Consequently, the pinion 4 slides underside the axially extending raised portion 5*a* and advances along the helical splines 3*a* for engagement with the ring gear.

When the pinion 4 is set in full engagement with the ring gear, i.e., the pinion 4 advances by an axial length of the raised portion 5*a*, the raised portion 5*a* comes off the groove 27*a* of the rotation control plate 27 and drops behind the rotation control plate 27 to release the pinion 4 from rotation restraint.

At the time the raised portion 5*a* is allowed to drop behind the rotation control plate 27, the plunger 41 is attracted further toward the stationary core 40 and, consequently, the main movable contact 20 comes into contact with the main stationary contact 50, so that the resistors 51 are short-circuited and the electric current flows from the power terminal 49 through the main stationary contact 50→the main movable contact 20→the lead wire 19→the positive pole brush 10*a*→the armature 9→the negative pole brush 10*b*→the lead wire 21→the holder 11, bypassing the resistors 51. Consequently, the rated voltage or full battery voltage is applied to the motor 2, the armature 9 rotates at a high rotating speed and the pinion 4 drives the ring gear to start the engine.

Although the auxiliary movable contact 53 is in contact with the auxiliary stationary contact 52 and the auxiliary movable contact 53 is restrained from movement when the raised portion 5*a* drops behind the rotation control plate 27, the plunger 41 is not restrained from further movement because the elastic holding arm member 56 bends.

In a state where the pinion 4 has been advanced and engaged with the ring gear, the biasing force of the spring 26 is increased. When the pinion 4 is driven for rotation by the ring gear after the engine has been started, the combined force of the torque of the engine and the helical splines 3*a* acts to bias the pinion 4 axially away from the ring gear. However, the pinion 4 is unable to move back because the extremity of the raised portion 5*a* lying behind the rotation control plate 27 is in contact with the rear surface of the rotation control plate 27.

Subsequently, the starter switch 44 is turned off to de-energize the coil 39. Then, the plunger 41 attracted toward the stationary core 40 returns to its initial position shown in FIG. 1 by the force of the return spring 42 and the main movable contact 20 and the auxiliary movable contact 53 are separated from the main stationary contact 50 and the auxiliary stationary contact 52, respectively, and the rotating armature 9 stops. On the other hand, as the plunger 41 returns to its initial position, a pulling force applied through the string-like member 36 to the rotation control member 5 is removed and the rotation control member 5 is returned to its initial position by the force of the return spring. Consequently, the raised portion 5*a* which has been restraining the pinion 4 from rearward movement is disengaged from the rotation control plate 27 and the pinion 4 is returned to its initial position shown in FIG. 1 by the force of the spring 26.

Effects

In the starter 1 in this embodiment, the one end of each resistor 51 is connected to the head 49*a* of the power terminal 49 projecting into the inside of the end cover 13, and the other end of the same is connected to the contact holding member 55 holding the auxiliary stationary contact 52. Therefore, the auxiliary stationary contact 52 is not cooled quickly and the icing of the auxiliary stationary contact 52 can be prevented even if the starter 1 is used in a cold district or weather condition and the power terminal 49 of the starter 1 is cooled, because the thermal conductivity of the resistors 51 is as small as several tenths of that of copper. Thus, the motor 2 starts operating smoothly. The contact holding member 55 may be omitted and other end of each of the resistors 51 may be directly connected to the auxiliary stationary contact 52.

The main stationary contact 50 formed integrally with the head 49*a* of the power terminal 49 may possibly be iced when the power terminal 49 is cooled. However, the main stationary contact 50 can be deiced by the heat generated by the resistors 51. When a current is supplied through the resistors 51 to the motor for low-voltage starting, the resistor 51 generates heat, the heat is transferred efficiently by conduction to the main stationary contact 50 and the surface of the main stationary contact 50 is heated by radiant heat. Consequently, the surface of the contact 50 is deiced rapidly to prevent unsatisfactory electrical connection due to icing. Tests conducted by the inventors proved that time necessary for deicing the contact iced at −30° C. to restore the contact to a conductive state was in the range of 0.5 to 0.6 sec.

The starter 1 in this embodiment is able to prevent malfunction or inoperativeness due to the icing of the surface of the contact, scarcely delays the start of the engine after the starter switch 44 has been turned on, does not give the user any sense of incompatibility and has an improved operability far desirable than that of the conventional starter.

Since the auxiliary movable contact 53 is connected mechanically and electrically to the main movable contact 20 by the elastic holding arm member 56, the contact pressure between the auxiliary movable contact 53 and the auxiliary stationary contact 52 can be secured by the elasticity of the holding arm member 56. Since the holding arm member 56 can be used as a contact pressure spring for pressing the auxiliary movable contact 53 at a contact pressure against the auxiliary stationary contact 52, any special contact pressure spring and any special holding member for holding the contact pressure spring are not necessary, so that the number of the component parts can be reduced.

The holding arm member 56 has the curved portion between its one end connected to the main movable contact 20 and the other end connected to the auxiliary movable contact 53. Therefore, the overall length of the holding arm member 56 is greater than the length of a straight line interconnecting the main movable contact 20 and the auxiliary movable contact 53. Since the overall length of the holding arm member having the curved portion is relatively long, stress that is induced in the holding arm member 56 when the same is bent as the rod 43 is moved can be reduced. Since the holding arm member 56 is not formed in a linear shape and is provided with the curved portion, the auxiliary movable contact 53 can be disposed near the main movable contact 20; that is, although the overall length of the holding arm member 56 is relatively long, the starter 1 can be formed in a compact construction.

The position of the auxiliary movable contact 53 relative to the auxiliary stationary contact 52 changes as the plunger 41 moves after the auxiliary movable contact 53 has been brought into contact with the auxiliary stationary contact 52; that is the auxiliary movable contact 53 slides relative to the contact surface of the auxiliary stationary contact 52 from a position at which the auxiliary movable contact 53 comes first into contact with the auxiliary stationary contact 52 for wiping action while the main movable contact 20 moves until the same comes into contact with the main stationary contact 50, whereby satisfactory electrical contact between the auxiliary movable contact 20 and the auxiliary stationary contact 50 can be secured, which improves the reliability of the starter 1.

Second Embodiment

Figure 4:
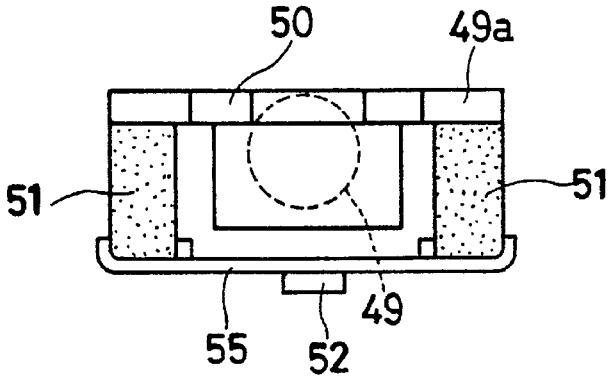
FIG. 4 is a front view of a contact device according to a second embodiment of the present invention.

FIG. 4 is a front view, similar to a view taken along the arrow III in FIG. 1, of a portion including contacts of a second embodiment.

The second embodiment is different from the first embodiment in that resistors 51 made of a nonmetallic material, such as carbon, graphite or a silicon carbide ceramic material, are used as the heat generating member. The resistors 51 made of such a nonmetallic material are superior in corrosion resistance to the resistors 51 of the first embodiment made of a metal and highly durable, and function with improved reliability.

Third Embodiment

Figure 5:
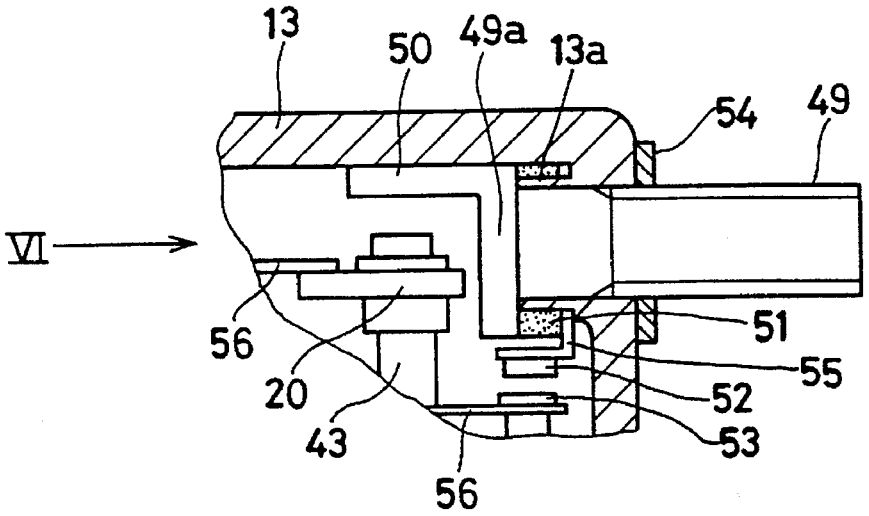
FIG. 5 is a partial side view, in cross section, of a contact device according to a third embodiment of the present invention.
Figure 6:
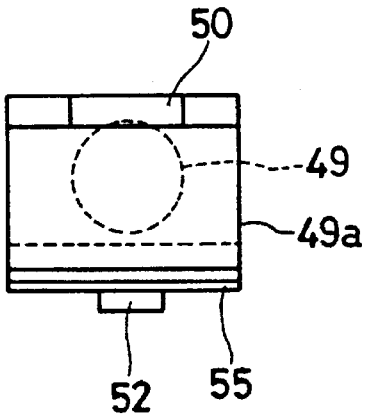
FIG. 6 is a front view of the contact device when viewed along the arrow VI in FIG. 5.

FIG. 5 is a sectional view of the contact device as positioned in place and FIG. 6 is a view taken along the arrow VI in FIG. 5.

A resistor 51 and a contact holding member 55 are provided in their central portions with round openings, respectively, are placed on a cylindrical projection 13*a* formed integrally with an end cover 13 so as to project into the inside of the end cover 13 and are held between the head 49*a* of a power terminal 49 and the inner surface of the end cover 13 as shown in FIG. 5.

When a starter switch 44 is turned on to actuate a magnet switch 6 and an auxiliary movable contact 53 is brought into contact with an auxiliary stationary contact 52, an electric current from a battery 45 flows through the power terminal 49→the head 49*a* of the power terminal 49→the resistor 51→the contact holding member 55→the auxiliary stationary contact 52→the auxiliary movable contact 53.

Since the resistor 51 and the contact holding member 55 are formed in the shape of plate (rectangular plate), respectively, and put on the cylindrical projection 13*a* of the end cover 13, the portion including the terminal, as compared with the same portion in the first embodiment, can be formed in a compact construction as shown in FIG. 6.

Fourth Embodiment

Figure 7A:
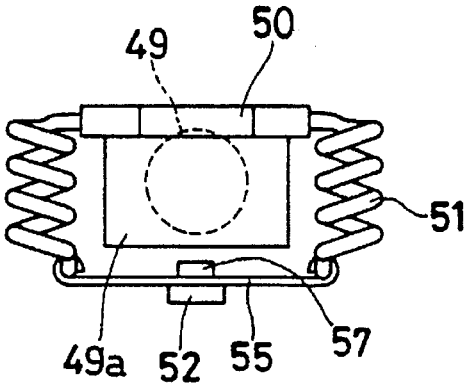
FIGS. 7A and 7B are front views of a contact device according to a fourth embodiment of the present invention.
Figure 7B:
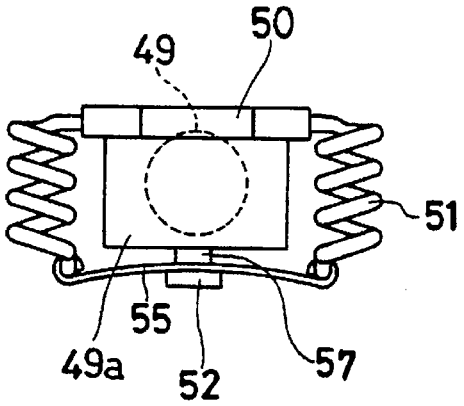

FIGS. 7A and 7B are front views, similar to a view taken along the arrow III in FIG. 1, of a contact portion in a fourth embodiment.

In the fourth embodiment, a contact holding member 55 corresponding to the contact holding member 55 of the first embodiment is formed of a bimetal. As shown in FIG. 7A, an auxiliary stationary contact 52 is attached on one side of the contact holding member 55 and a resistor short-circuiting contact 57 is attached to the other side of the contact holding member 55. Although the auxiliary stationary contact 52 and the resistor short-circuiting contact 57 may be separate members, the auxiliary stationary contact 52 and the resistor short-circuiting contact 57 may be formed in a monolithic part to reduce the number of component parts.

Since the contact holding member 55 is formed of the bimetal, the contact holding member 55 warps in an upward convex shape as shown in FIG. 7B, i.e., convex toward the head 49*a* of a power terminal 49, when an electric current continues to flow for an excessively long time and the resistor short-circuiting contact 57 is brought into electrical contact with the lower surface of the head 49*a* of the power terminal 49. Consequently, resistors 51 are short-circuited and a current from a battery 45 flows through the power terminal 49→the resistor short-circuiting contact 57→the contact holding member 55→the auxiliary stationary contact 52→an auxiliary movable contact 53. Therefore, the resistors 51 do not generate excessive heat even if the electric current flows through the resistors 51 for an excessively long time and the durability can be improved. Since it is necessary for preventing the overheating of the resistors 51 only to form the contact holding member 55 of the bimetal and to attach the resistor short-circuiting contact 57 to the contact holding member 55, the construction of the portion including the contacts does not become complex and the size of the device need not be increased.

Fifth Embodiment

In a fifth embodiment shown in FIGS. 8, 9A1 through 9B2 and 10A1 through 10B2 in a simplified form, a main movable contact 20 and an auxiliary movable contact 53 are shown by dotted lines, and resistors 51, a rod 43 and a lead wire 19 are shown to the extent necessary. This embodiment is different from the fourth embodiment in that, although a contact holding member 55 is made of a bimetal, resistors 51 are prevented from overheating in different ways.

Figure 8:
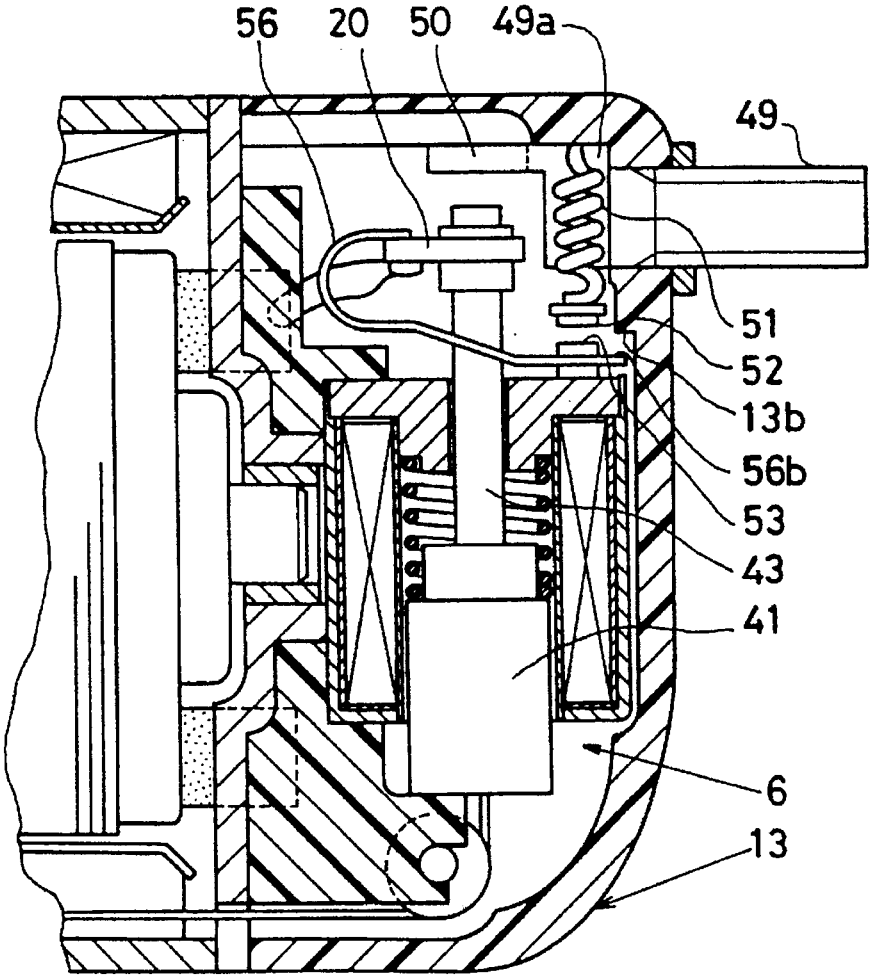
FIG. 8 is a partial side view, in cross section, of a magnet switch portion according to a fifth embodiment of the present invention.

As shown in FIG. 8, a stepped restricting wall **13*b* is formed on the inside of an end cover 13 to restrict a distance of upward movement of an auxiliary movable contact 53 to a predetermined amount upon movement of the auxiliary movable contact 53 caused by the operation of a magnet switch 6**.

When the magnet switch 6 is not operated, the contact device takes the position shown in FIGS. 9A1 and 9A2. When a starter switch 44 is turned on to operate the magnet switch 6, the auxiliary movable contact 53, moving together with the plunger 41 and the rod 43, contacts the auxiliary stationary contact 52 as shown in FIGS. 9B1 and 9B2, and the starter motor 2 starts rotation at low speeds with the low electric current flowing through the resistors 51.

While the pinion 4 advances for engagement with the ring gear, the rod 43 moves upward further and the main movable contact 20 flexes the holding member 56 to abut the main stationary contact 50 as shown in FIGS. 10A1 and 10A2. As a result, the motor 2 is released from the electric current restriction by the resistors 51 and rotates with the rated voltage. In the event that the main fixed contact 50 is unable to conduct with the main movable contact 20 due to icing on the surface of the main stationary contact, the electric current flows through the resistors 51 for a longer time than usual. The contact holding member 55 made of the bimetal curves upward due to the heat generation in the contact holding member 55 and in itself, so that the auxiliary movable contact 53 tends to move upward. At this time, however, since an end of the holding member 56 touches the restricting wall **13*b* provided inside the end cover 13, the auxiliary movable contact 53 is stopped moving upward further and the auxiliary stationary contact 52 is disconnected from the auxiliary movable contact 53 as shown in FIGS. 10B1 and 10B2, thereby cutting off the current flow through the resistors 51. As a result, even when the electric current tends to flow through the resistors 51 for the unnecessarily long period, the resistors 51** do not generate the heat unnecessarily and its durability is not degraded.

Sixth Embodiment

Figure 11:
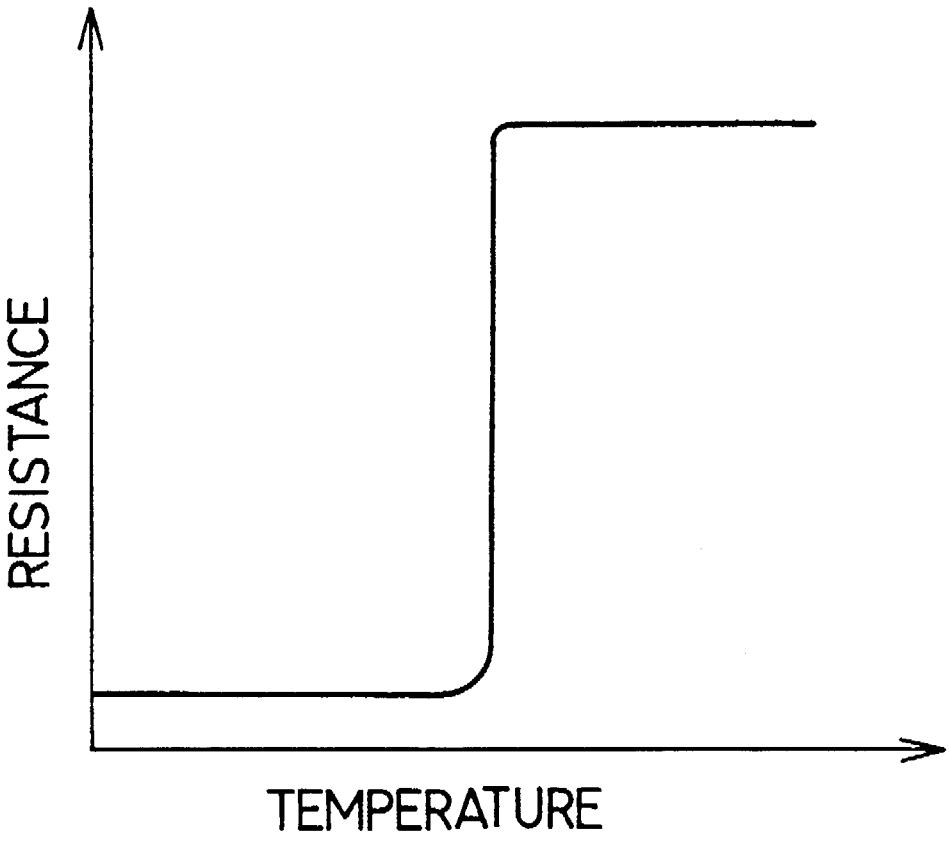
FIGS. 11 is a graph showing a temperature-resistance characteristics of a thermistor.

FIG. 11 is a graph showing the resistance characteristics of a thermistor having a positive temperature coefficient of resistance.

In a sixth embodiment, resistors 51 are formed of a thermistor having a positive temperature coefficient of resistance (PTC). The resistors 51 are applicable to the first to the third embodiments. When an electric current flows through the resistors 51 for an excessively long time and the temperature of the resistors 51 increases to a predetermined temperature, the resistance of the PTC increases as shown in FIG. 11 to suppress the electric current. Consequently, similarly to the fourth embodiment, the excessive heat generation in the resistors 51 can be suppressed. In addition, since this embodiment does not need the resistor short-circuiting contact 57 used in the fourth embodiment, as compared with the fourth embodiment, the magnet switch can be constructed with a less number of parts and has a simpler construction.

Modifications

The holding arm member 56 of the first embodiment need not necessarily be formed in a curved shape, but may be formed, for example, in a shape substantially resembling the letter U or a round shape like a coil. Essentially, the holding arm member 56 may be formed in any suitable shape, provided that the holding arm member 56 has a length sufficient to reduce stress that is induced therein when the holding arm member 56 is bent and the auxiliary movable contact 53 can be disposed near the main movable contact 20.

What is claimed is:

1. A magnet switch for a starter for supplying an electric current from a battery to a starter motor, the magnet switch comprising:

a main stationary contact connectable to the battery;

a heat generating member electrically connected to the main stationary contact for generating heat when the current is supplied thereto; and an auxiliary stationary contact electrically connected to the main stationary contact through the heat generating member, wherein the main stationary contact and the auxiliary stationary contact are adapted to be brought into a conducting state to control current supply to the starter motor.

2. A magnet switch according to claim 1, wherein:

the heat generating member includes an electric resistor for limiting the electric current to be supplied to the starter motor, and the heat generating member is first used to limit the electric current supplied from the battery to the starter motor and then short-circuited to supply the electric current from the battery to the starter motor without passing through the heat generating member.

3. A magnet switch according to claim 2, further comprising:

a main movable contact movable to contact with the main stationary contact;

an auxiliary movable contact movable to contact with the auxiliary stationary contact; and a plunger for moving the main and the auxiliary movable contacts toward the main and the auxiliary stationary contacts respectively, wherein the plunger first causes the auxiliary movable contact to contact the stationary movable contact so that the electric current is supplied from the battery to the starter motor through the heat generating member, and then causes the main movable contact to contact the main stationary contact so that the heat generating member is short-circuited and the electric current is supplied from the battery to the starter motor without passing through the heat generating member.

4. A magnet switch according to claim 3, wherein:

the auxiliary movable contact is electrically connected to the main movable contact; and one of the auxiliary movable contact and the main movable contact is connected electrically to the starter motor.

5. A magnet switch according to claim 4, further comprising:

an elastic conductive holding member for connecting the auxiliary movable contact and the main movable contact mechanically and electrically.

6. A magnet switch according to claim 5, wherein:

the holding member has a curved portion formed between one end thereof connected to the main movable contact and another end thereof connected to the auxiliary movable contact.

7. A magnet switch according to claim 2, further comprising:

a contact holding member made of a bimetal and disposed between the heat generating member and the auxiliary stationary contact for holding the auxiliary stationary contact.

8. A magnet switch according to claim 7, wherein:

the heat generating member includes a pair of heat generating elements each having one end connected to the main stationary contact and another end fixed to the contact holding member.

9. A magnet switch according to claim 7 further comprising:

a plunger having a movable contact for contact with the auxiliary stationary contact; and a short-circuiting contact adapted to contact the main stationary contact for short-circuiting the heat generating member when the contact holding member is elastically deformed by a movement of the plunger.

10. A magnet switch according to claim 7, wherein:

the contact holding member is adapted to deform elastically upon movement of the plunger and move the auxiliary movable contact away from the auxiliary fixed contact.

11. A magnet switch according to claim 9, wherein:

the short-circuiting member and the auxiliary stationary contact are formed integrally.

12. A magnet switch according to claim 1, wherein:

the heat generating member is formed of a thermistor having a positive temperature coefficient of resistance.

13. A magnet switch according to claim 8 further comprising:

a plunger having a movable contact for contact with the auxiliary stationary contact; and a short-circuiting contact adapted to contact the main stationary contact for short-circuiting the heat generating member when the contact holding member is elastically deformed by a movement of the plunger.

14. A magnet switch according to claim 8, wherein:

the contact holding member is adapted to deform elastically upon movement of the plunger and move the auxiliary movable contact away from the auxiliary fixed contact.

15. A magnet switch according to claim 13, wherein:

the short-circuiting member and the auxiliary stationary contact are formed integrally.

* * * * *